US011141947B2

(12) United States Patent
Lootvoet et al.

(10) Patent No.: US 11,141,947 B2
(45) Date of Patent: Oct. 12, 2021

(54) DEVICE FOR PROCESSING A PLATE ELEMENT, PROCESSING UNIT AND PACKAGING PRODUCTION MACHINE

(71) Applicant: BOBST LYON, Villeurbanne (FR)

(72) Inventors: Thomas Lootvoet, Chaponnay (FR); Olivier Boudry, Sangatte (FR)

(73) Assignee: BOBST LYON

( * ) Notice: Subject to any disclaimer, the term of this patent is extended or adjusted under 35 U.S.C. 154(b) by 108 days.

(21) Appl. No.: 16/190,540

(22) Filed: Nov. 14, 2018

(65) Prior Publication Data

US 2019/0077107 A1 Mar. 14, 2019

Related U.S. Application Data

(63) Continuation of application No. 14/239,710, filed as application No. PCT/EP2012/003584 on Aug. 24, 2012, now abandoned.

(30) Foreign Application Priority Data

Aug. 31, 2011 (FR) ..... 1102645

(51) Int. Cl.
*B31B 50/02* (2017.01)
*B31B 50/20* (2017.01)
(Continued)

(52) U.S. Cl.
CPC ..... *B31B 50/146* (2017.08); *B26D 5/20* (2013.01); *B31B 50/02* (2017.08); *B31B 50/20* (2017.08);
(Continued)

(58) Field of Classification Search
CPC ..... B31B 50/006; B31B 50/22; B31B 50/146; B31B 50/256; B26D 7/2642; B26D 3/14
(Continued)

(56) References Cited

U.S. PATENT DOCUMENTS 2,020,996 A 11/1935 Crafts
2,181,197 A 11/1939 Moritz
(Continued)

FOREIGN PATENT DOCUMENTS

EP 0 539 254 4/1993
EP 1 247 625 10/2002
(Continued)

OTHER PUBLICATIONS

International Search Report dated Dec. 10, 2012 issued in corresponding PCT International Application No. PCT/EP2012/003584.
(Continued)

*Primary Examiner* — Joshua G Kotis
(74) *Attorney, Agent, or Firm* — Ostrolenk Faber LLP

(57) ABSTRACT

A device for processing a plate element (35) has a rotable hub (52), two tools (57, 58), mounted on the hub (52) to process the element (35) when each tool is in a respective processing position; a drive to rotate the hub (52) and the two tools (57, 58); a rotatable counter-tool (64). The rotation (R) of the hub (52) varies during a rotation cycle of the hub (52), and includes two constant speed phases during each of which one of the two tools (57, 58) is, in succession, in the processing position; and at least one phase with each of the two tools (57, 58) in an intermediate position between the respective processing positions, so as to achieve a front lateral processing position and a rear lateral processing position on the element (35).

14 Claims, 4 Drawing Sheets

(51) Int. Cl.

| | |
|---|---|
| ***B31B 50/22*** | (2017.01) |
| ***B31B 50/14*** | (2017.01) |
| ***B26D 5/20*** | (2006.01) |
| *B31B 100/00* | (2017.01) |
| *B31B 110/35* | (2017.01) |

(52) U.S. Cl.
CPC ..... *B31B 50/22* (2017.08); *B31B 2100/00* (2017.08); *B31B 2100/0022* (2017.08); *B31B 2110/35* (2017.08)

(58) Field of Classification Search
USPC .... 493/365–367, 370, 371, 60; 83/311, 324, 83/332, 38, 698.41, 673, 675
See application file for complete search history.

(56) References Cited

U.S. PATENT DOCUMENTS

| | | | | |
|---|---|---|---|---|
| 2,808,106 | A | 10/1957 | Belton | |
| 2,850,092 | A | 9/1958 | Alfred | |
| 2,982,189 | A | 5/1961 | Shields | |
| 3,087,392 | A | 4/1963 | Ward, Jr. | |
| 3,448,646 | A * | 6/1969 | Bishop | B23Q 5/266 83/303 |
| 3,952,637 | A | 4/1976 | Lambert | |
| 4,003,300 | A | 1/1977 | Grobman | |
| 4,098,173 | A | 7/1978 | Schauman | |
| 4,604,083 | A | 8/1986 | Barny | |
| 4,725,261 | A | 2/1988 | Millard | |
| 5,181,899 | A | 1/1993 | Hill | |
| 5,315,907 | A * | 5/1994 | Biagiotti | B26D 3/16 83/38 |
| 5,344,377 | A | 9/1994 | Meeks | |
| 5,447,486 | A | 9/1995 | Anderson | |
| 5,699,710 | A | 12/1997 | Creaden | |
| 5,816,994 | A | 10/1998 | Hill | |
| 6,059,705 | A | 5/2000 | Ruthenberg | |
| 6,106,448 | A | 8/2000 | Obara | |
| 6,422,113 | B1 | 7/2002 | Blume | |
| 6,475,128 | B1 | 11/2002 | Wallace et al. | |
| 6,652,434 | B2 * | 11/2003 | Benzoni | B26D 3/12 493/245 |
| 6,773,384 | B2 | 8/2004 | Guiot | |
| 7,691,044 | B2 * | 4/2010 | Petratto | B31F 1/0025 493/397 |
| 7,913,989 | B2 * | 3/2011 | Sandahl | B41F 13/60 270/42 |
| 2003/0191001 | A1 | 10/2003 | Guiot et al. | |
| 2004/0154447 | A1 * | 8/2004 | Di Carlo | B26D 1/385 83/311 |
| 2005/0166746 | A1 | 8/2005 | Garrett | |
| 2009/0029837 | A1 | 1/2009 | Mansfield | |
| 2011/0092351 | A1 | 4/2011 | Hatano | |
| 2014/0162862 | A1 | 6/2014 | Shimura | |

FOREIGN PATENT DOCUMENTS

| | | |
|---|---|---|
| GB | 915 555 | 1/1963 |
| GB | 2302834 | 2/1997 |
| JP | H11-79112 A | 3/1999 |
| JP | 2000-079645 A | 3/2000 |
| WO | WO 02/02305 | 1/2002 |

OTHER PUBLICATIONS

Notice on the First Office Action and Search Report dated Jun. 30, 2015 in corresponding Chinese Patent Application No. 201280042054.3 with English translation.
Notice on the Second Office Action dated Feb. 22, 2016 in corresponding Chinese Patent Application No. 201280042054.3 with English translation.
Notification of Reason(s) for Rejection dated Feb. 2, 2015 in corresponding Japanese Patent Application No. 2014-527523 with English translation.
Examination Report and Search Report dated Apr. 21, 2014 in corresponding Taiwanese Patent Application No. 101131124 English translation.

* cited by examiner

DEVICE FOR PROCESSING A PLATE ELEMENT, PROCESSING UNIT AND PACKAGING PRODUCTION MACHINE

CROSS REFERENCE TO RELATED APPLICATIONS

The present application is a continuation under 37 C.F.R. § 1.53(b) of prior U.S. patent application Ser. No. 14/239,710, filed Feb. 19, 2014, which in turn is a 35 U.S.C. § 371 National Phase conversion of PCT/EP2012/003584, filed Aug. 24, 2012, which claims benefit of French Application No. 1103645, filed Aug. 31, 2011, the entire contents of each of these applications are incorporated herein by reference.

TECHNICAL FIELD OF THE INVENTION

The present invention relates to a device for processing a plate element in a packaging production machine. The invention relates to a unit for processing plate elements, comprising such a processing device. The invention also relates to a machine for producing packaging from plate elements, comprising a processing unit equipped with such a processing device.

BACKGROUND OF THE INVENTION

In the packaging industry, a packaging production machine is generally used to ensure the making of cardboard boxes or cases, for example made of corrugated cardboard. Plate elements, taking the form of cardboard sheets, are introduced in succession into the machine and continuously run in the drive direction. They are automatically printed by flexography, cut and creased, folded and joined by gluing, so as to form the cases.

In what are called "transverse" machines, for example those described in document WO 02/02.305 the cuts or folds are, at least mainly, made transversely relative to the run direction of the sheets in the machine. In these transverse machines, the various cutting and creasing tools are borne by beams that are placed transversely relative to the run direction of the sheets and that may be moved vertically between a working position and a retracted position. Various tools may be mounted on the beams, thereby allowing a variety of packaging to be produced.

In what are called "longitudinal" machines, for example those described in document EP 0.539.254, most of the folds and cuts are made in the run direction of the sheets in the machine. Longitudinal machines achieve high production rates. The various producing steps are carried out using cylinders rotating at a high speed. The evolute of each cylinder defines the length of the sheets that it is possible to process in the machine. Therefore, with a given longitudinal machine, only packaging having a length that varies over a narrow range, defined by the minimum and maximum evolutes of the machine, can be produced.

The longitudinal machine thus comprises a processing unit equipped with a processing tooling called a slotter. The processing unit is located between a printing unit and a folding/gluing unit. The tooling processes the preprinted plate element and converts it into a blank ready to be folded and glued.

The processing tooling comprises rotary cutting tools with laterally spaced blades arranged so as to create slots at, and from, front and rear edges of the plate element. The processing tooling also comprises laterally spaced rotary creasing tools arranged so as to create fold lines on the plate element. These tools are borne by a number of transverse support shafts each of which being driven in rotation by shaft motors. Each of these tools interacts with a counter-tool placed on a parallel transverse bearing shaft, the plate elements running between the tools and the counter-tools.

Driving means drive the plate elements at a drive speed, also called the operating speed, which is substantially constant between the inlet and exit of the machine. The machine comprises a control unit able to control the shaft motors so that, in order to process this plate element, the tooling makes contact with a preset region of the plate element and is advanced at a processing speed the tangential component of which is equal to the drive speed. Such machines achieve high producing rates, for example about twenty thousand cases per hour.

Because of the shape of the case, it is also necessary to make cuts in the transverse direction, relative to the drive direction of the plate element. This is because the plate element comprises a lateral glue flap cut and forming an extension of the four central panels forming the four sides of the case. Post-folding, this flap is glued to the opposite panel, thereby closing the case.

The flap must therefore be cut in the processing unit, with a first slot from the rear edge, a second slot from the front edge, and two front and rear transverse cuts from the lateral edge.

PRIOR ART

Document EP 1.247.625 describes a device mounted in a splitting machine for manufacturing packaging boxes. The device is used to cut a flap in a plate element. The device comprises two upper transverse shafts that lie parallel to each other. A cutting blade is mounted on the end of each of the shafts. The blades are inclined in the transverse direction so as to ensure the slanted desired cut. The upstream blade cuts the rear of the flap and the downstream blade cuts the front of the flap. The front and rear cuts are made simultaneously, the blades lying parallel to each other at the moment the cuts are made.

Each of the two blades has a corresponding counter-tool taking the form of a rubber-covered cylinder. The two counter-tools are mounted on two lower transverse shafts that lie parallel to each other. The plate element is driven running between the blades and the counter-tool and the flap is cut. The two shafts of the two blades and the two shafts of the two counter-tools are driven in rotation by a single motor and a toothed belt.

However, with such a device, the length of the flap is always defined by the gap between the two blades and thus between the two bearing shafts. Any change to the case format, and thus to the flap size, requires a full dismantling and reassembling of the device with the new position of cutting shafts and blades. This machine shutdown for a job change considerably decreases overall productivity. In addition, simultaneously driving the two blades and the two counter-tools leads to substantial inertia, thereby limiting the operating speed of the device and of the packaging manufacturing machine.

It is known from document GB 2.411.142 a rotary cutting device in a packaging making machine. The device cuts a glue flap in a plate element that is subsequently able to form a case. The device comprises a pair of shafts placed one above the other, the element running between the two shafts. Each of the shafts possesses a pair of knives mounted at their proximal ends. The two knives are mounted in opposition at 180° to each other on the same shaft.

The two shafts are driven synchronously, so that the two knives interact to produce the shear cutting. One of the two knives on the upper shaft cuts the upper side of the element and one of the two knives on the lower shaft simultaneously cuts the lower side of the element. A full rotation of the two shafts enables the two front and rear cuts to be made.

A sensor, for detecting the front edge of the cut, and a regulator allow to control the timing for partial rotations from a neutral position where the knives are horizontal to a cutting position where the knives are vertical, and so on, each time rotating through a quarter turn.

However, with such a device, the length of the flap is always defined by the length of the evolute of the semi-perimeter located between the two blades of a given shaft. Any change to the case format, and thus to the flap size, requires full dismantling and reassembling of the device with a new shaft or new hub to increase the perimeter. This significant downtime required to change jobs proves expensive because during this time the whole production of the machine is stopped.

In addition, the accuracy of the cutting of the flap is not guaranteed, due to rapid stops of the motor and the blades in the neutral position and then accelerate to the cutting position. The kinematics between the upper blade and the lower blade generates too much inertia, which is incompatible with high operating speeds and thereby limits the flap lengths that can be achieved.

SUMMARY OF THE INVENTION

A main object of the present invention is to provide a device allowing a plate element to be processed in a packaging production machine. A second object is to provide a device equipped with two processing tools, each of the two tools processing the plate element in succession. A third object is to provide a device that allows plate elements of any size to be processed and that especially allows the production of glue flaps. A fourth object is to solve the technical problems mentioned above with regard to the documents of the prior art. A fifth object is to place a processing device in a unit for processing plate elements. Yet another object is the successful installation of a processing unit equipped with such a processing device in a packaging production machine.

A device for processing a plate element is mounted on a lateral side of a packaging production machine, the plate element running at an operating speed. The device comprises:

a hub, rotating about a substantially horizontal and transverse rotation axis;

two tools, mounted on the hub, the two tools being able to process the plate element in a respective processing position;

driving means, able to drive the hub and the two tools in rotation; and a counter-tool, rotating about a rotation axis that is substantially horizontal, transverse and parallel to the rotation axis of the hub, the plate element being engaged between the two tools and the counter-tool.

According to one aspect of the present invention, the device is characterized in that a speed of rotation of the hub varies during a rotation cycle of the hub, and includes:

two phases at a constant speed substantially equal to the operating speed, and during which phases each of the two tools is, in succession, in the processing position for processing the plate element; and at least one phase in which the speed varies, during which phase each of the two tools is in an intermediate position between the respective processing positions of each of the two tools, so as to achieve a front lateral processing position and a rear lateral processing position on the plate element.

In other words, by changing the speed during a processing cycle, the device allows plate elements of different sizes to be processed. The acceleration of the hub of the device, and thus of the processing tools, is adjusted depending on the length desired between the two processed regions of the plate element. The hub with its two tools accelerates and then decelerates to match the run speed of the plate element, which is also the operating speed of the machine. This speed is the optimal speed and that at which each of the two tools processes the plate element.

The speed of rotation comprises a first constant-speed phase, substantially equal to the speed of the plate element, and in which the first tool carries out a first processing operation on the plate element. The rotation speed comprises a second constant-speed phase, substantially equal to the speed of the plate element, and in which the second tool carries out a second processing operation on the plate element.

The speed of rotation varies between the first constant-speed phase and the second constant-speed phase in a given tool-rotation cycle, and/or between the second constant-speed phase in a first tool-rotation cycle and the first constant-speed phase in a second tool-rotation cycle following the first cycle.

This variation in the speed of the hub bearing the two tools firstly allows the first tool to be precisely positioned in the desired position thereof so as to carry out the first processing operation on the plate element, and then allows the second tool to be precisely positioned so as to carry out the second processing operation on the plate element. The acceleration or deceleration of the hub bearing the two tools allows the delay or advance of each of the two tools relative to the constant run speed of the element to be respectively reduced. Adjusting the various speeds allows the arrival of the plate element to be synchronized with the processing operation of the first tool and then with the processing operation of the second tool, thereby allowing the distance between the two processing operations on the element to be adjusted. The device allows the elements to be processed at a high rate.

Because the device is positioned on one lateral side of a packaging production machine, the processing is carried out only at one end of the element. It is not necessary to adjust the distance separating the two tools. The adjustment to the format of the elements to be processed is obtained by adjusting speed parameters. The speed parameters and the speed phases define the distance separating the two processing positions of the element. The processing device is driven independently of the elements to be processed.

In another aspect of the invention, a unit for processing plate elements is characterized in that it comprises a device for processing a plate element having one or more of the technical features described and claimed below, mounted on a lateral side of a creasing section.

According to yet another aspect of the invention, a packaging production machine for manufacturing packaging from plate elements is characterized in that it comprises a unit for processing plate elements having one or more of the technical features described and claimed below, in between a printing unit and a folding/gluing unit. The machine, and thus the unit, are of the longitudinal type.

The longitudinal direction is defined with reference to the run or drive direction of the plate elements in the machine, in the processing unit and in the device, along their median longitudinal axis. The transverse direction is defined as being the direction perpendicular to the run direction of the plate elements. Upstream and downstream positions in the machine and unit are defined relative to the longitudinal direction and to the run direction of the element from the feeder at the machine entrance to the machine exit. Front and rear positions on the element are defined relative to the longitudinal direction and to the run direction of the element. Proximal and distal positions on the element are defined relative to the operator side and to the side opposite the operator of the machine when the element is running.

BRIEF DESCRIPTION OF THE DRAWINGS

The invention will be better understood and its various advantages and features will become more apparent from the following description of a non-limiting exemplary embodiment given with reference to the schematic drawings appended, in which.

DETAILED DESCRIPTION OF PREFERRED EMBODIMENTS

Figure 1:
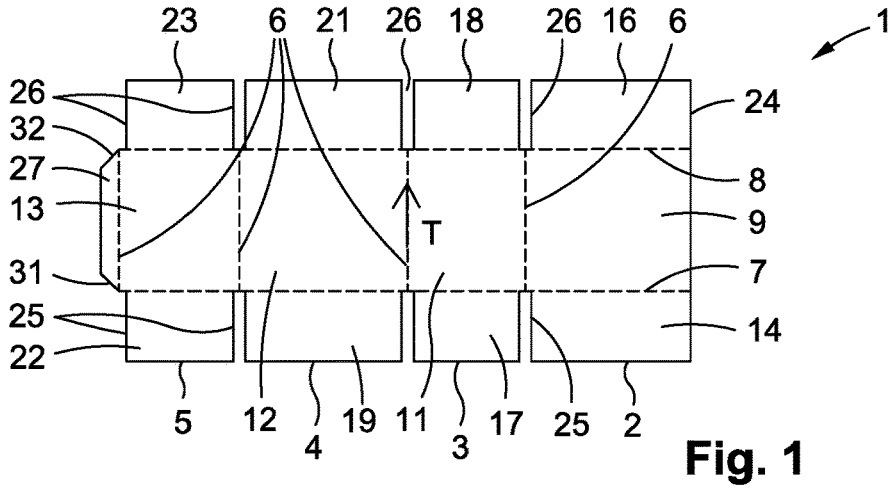
FIG. 1 shows a top view of a blank produced by a packaging production machine.
Figure 2:
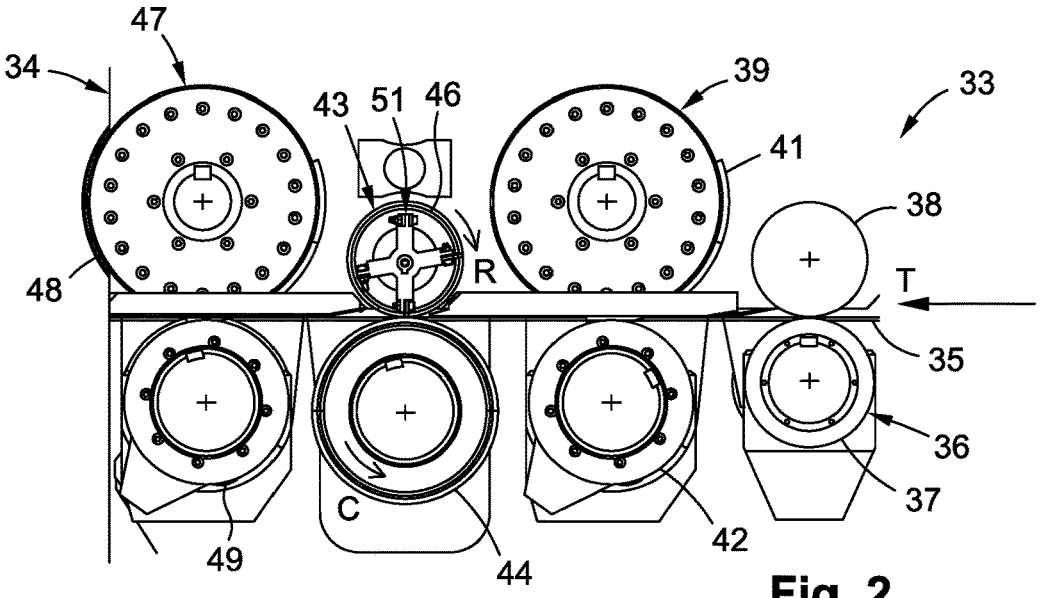
FIG. 2 shows a side view of a processing unit comprising a device according to the invention.

A cardboard blank 1, such as that illustrated in FIG. 1, is intended to form a case. Before folding, the blank 1 is formed by four adjacent portions 2, 3, 4 and 5, extending between two opposite lateral edges that lie parallel to the run direction (arrow T in FIGS. 1 to 8) of the blank 1 in the machine. The blank 1 is folded so that the distal end portion 2 and the proximal end portion 5 adjacent two opposite edges of the blank 1 are placed on the two central portions 3 and 4.

Four parallel longitudinal creases 6, extending longitudinally to the run direction T of the blank 1, and two parallel front 8 and rear 7 transverse creases, extending transversely to the run direction T of the blank 1, divide each portion 2, 3, 4 and 5 into panels 9, 11, 12 and 13, respectively.

The four panels 9, 11, 12 and 13 are intended to form the four sidewalls of the case. Each of the four panels 9, 11, 12 and 13 adjoins two rear and front flaps, 14 and 16, 17 and 18, 19 and 21, and 22 and 23, respectively. The flaps 14, 16, 17, 18, 19, 21, 22 and 23 are intended to close the upper and lower sides of this case.

An edge cut 24 forms the distal edge of the distal end part 2 and thus the distal panel 9 of the blank. Parallel longitudinal rear slots 25 are cut from the rear transverse edge of the blank 1 and separate the flaps 14, 17, 19 and 22 adjacent to the rear crease 7. Parallel longitudinal front slots 26 are cut from the front transverse edge of the blank 1 and separate the flaps 16, 18, 21 and 23 adjacent to the front crease 8.

To hold the case together after the folding operation, the distal end panel 9 is glued to the proximal end panel 13. To do this, the proximal end panel 13 has a glue strip or flap 27 that extends beyond the proximal lateral edge of the blank 1. During the folding operation, the distal end panel 9 is folded over the proximal end panel 13 so that the flap 27 is covered by the distal end panel 9. The flap 27 is folded and its lower side is coated with glue. The two end panels 9 and 13 of the blank 1 are fixed one to the other, after the end panel 9 has been folded over the end panel 13 and the flap 27 has been glued to the distal end panel 9, thus joining the four sidewalls 9, 11, 12 and 13 of the case.

The flap 27 is obtained by being cut out from the rest of the blank 1. To do this, the proximal rear slot 25 is cut from the rear transverse edge of the blank 1, parallel to the rear slots 25. A rear cut 31 is made with a substantial slant from the proximal longitudinal edge to the end of the proximal rear slot 25. The proximal front slot 26 is cut from the front transverse edge of the blank 1, parallel to the front slots 26. A front cut 32 is made with a substantial slant from the proximal longitudinal edge to the proximal front slot 26.

Figure 15:
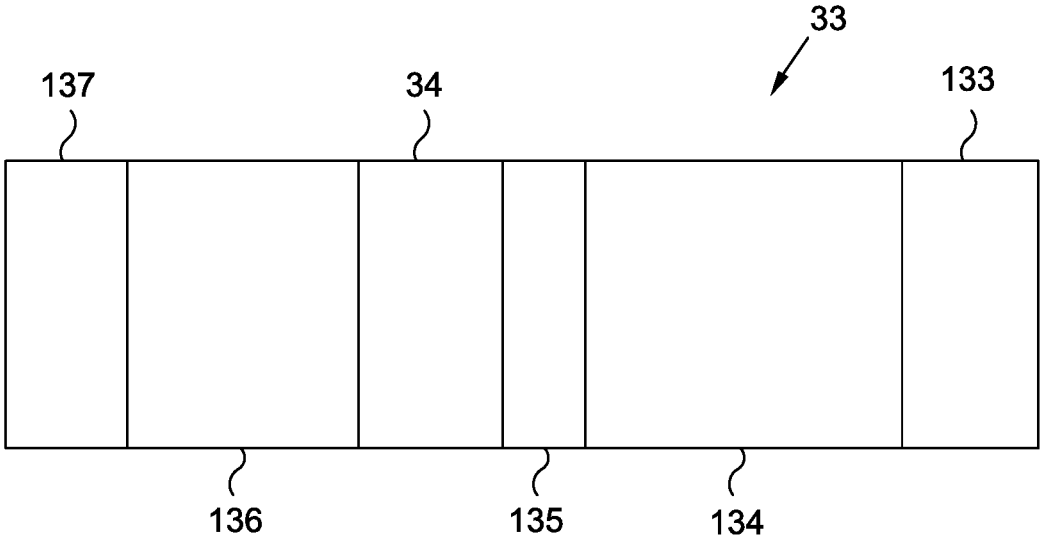
FIG. 15 illustrates a packaging production machine.

A plate element, such as a corrugated-cardboard sheet 35, is printed and cut to obtain the blank 1. The blank 1 is then folded and glued to obtain a case. To do this, a longitudinal packaging production machine 33 (See FIG. 15) preferably comprises a feeder 133 for feeding the machine with sheets 35. A printing unit, for example a flexography printing unit 134, is mounted downstream of and following the feeder 133. A unit for cutting the sheets 35 135, for producing special shapes or handles, is mounted downstream of and following the printing unit 134. A unit 34, or slotter, for processing the sheets 35 (see FIG. 2) is mounted downstream of and following the cutting unit 135. A unit for folding/gluing the blanks 1 136 is mounted downstream of and following the processing unit 34. And a machine outlet 137 for receiving the finished cases is mounted downstream and following the folding/gluing unit 136.

The processing unit 34 processes the printed sheets 35 exiting the printing unit and transforms them into blanks 1. The processing unit 34 is equipped with various toolings that comprise cutting tools or knives that form the edge cut 24, the slots 25 and 26, and the cuts 31 and 32, and creasing tools or creasers that form the longitudinal creases 6. It will be noted that the transverse creases 7 and 8 are produced upstream of the processing unit 34 or are initially provided in the corrugated-cardboard sheets 35.

The tools are mounted on transverse bearing shafts driven in rotation by shaft motors. The speed of rotation of the tools corresponds to the operating speed, i.e. the drive speed and running speed T of the sheets 35.

The processing unit 34 comprises, from upstream to downstream, a precreasing section 36, with a first pair of shafts positioned one above the other. The lower shaft bears a lower precreaser 37 and the upper shaft bears the upper counterpart 38 of the lower precreaser 37. The precreasing section 36 carries out a first initial creasing operation, creasing the longitudinal creases 6.

A first slotting section 39, with a second pair of shafts positioned one above the other, is mounted downstream of the precreasing section 36. The upper shaft of the first slotting section 39 bears a disk equipped with knives 41 and the lower shaft bears a lower counter-blade 42. The first slotting section 39 cuts the rear slots 25.

A creasing section 43, with a third pair of shafts positioned one above the other, is mounted downstream of the first slotting section 39. The lower shaft of the creasing section 43 bears a lower creaser 44 and the upper shaft bears an upper counterpart 46. The creasing section 43 carries out the final creasing operation and thus definitively ensures the retention of the longitudinal creases 6.

A second slotting section 47, with a fourth pair of shafts positioned one above the other, is mounted downstream of the creasing section 43. The upper shaft of the second slotting section 47 bears a roller equipped with knives 48 and the lower shaft bears a lower counterpart 49. The second slotting section 47 cuts the front slots 26.

In order to cut out the glue flap 27, and therefore make the rear cut 31 and the front cut 32 of the flap 27, the processing unit 34 comprises a device 51 for processing the sheets 35. The device 51 is placed in the creasing section 43. Given the proximal position of the flap 27 on the blank 1, the device 51 is mounted on the operator-side end of the upper shaft in the creasing section 43.

The device 51 comprises a central hub 52 rotating (arrow R in FIGS. 2 to 8) about an axis 53 of rotation lying substantially horizontal in a substantially transverse position. The processing tools are mounted on the hub 52 and are each able to process the sheet 35 in a respective processing position as the hub 52 rotates about its axis 53. The hub 52 is cantilevered above the sheet 35.

Figure 3:
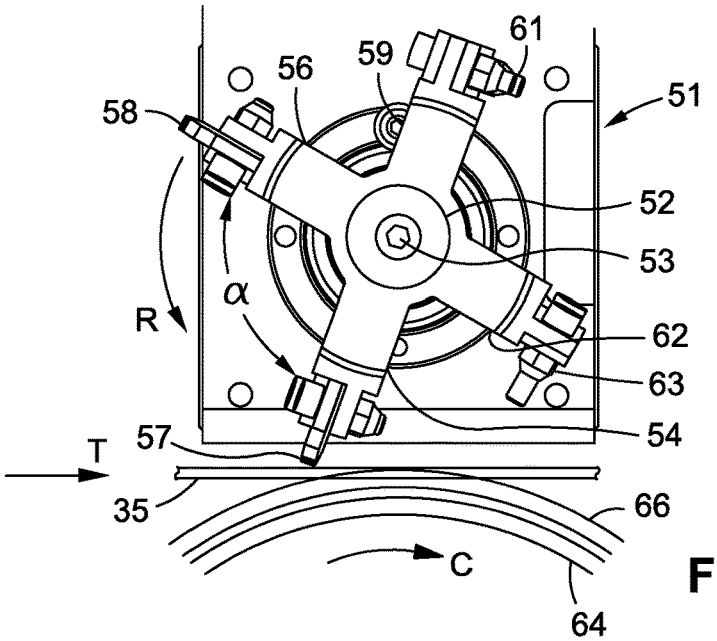
FIGS. 3 to 8 show partial side views showing the various positions adopted by the device during a rotation cycle.
Figure 4:
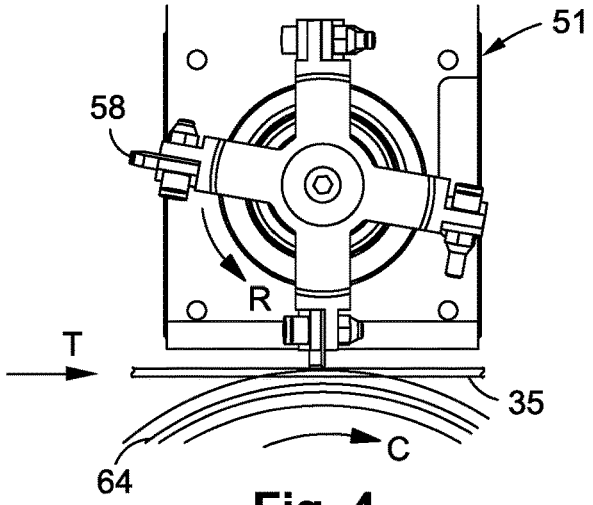
Figure 5:
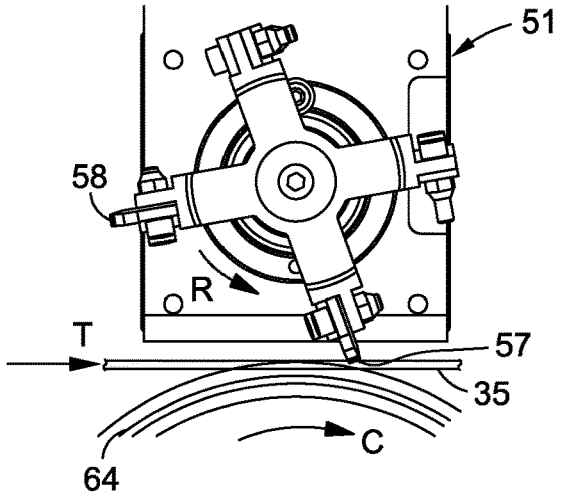
Figure 6:
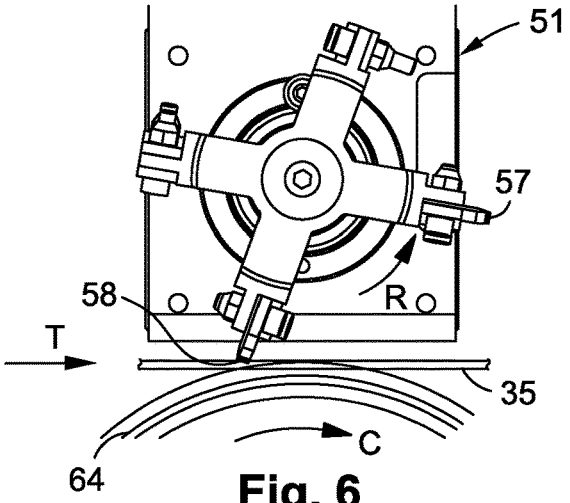
Figure 7:
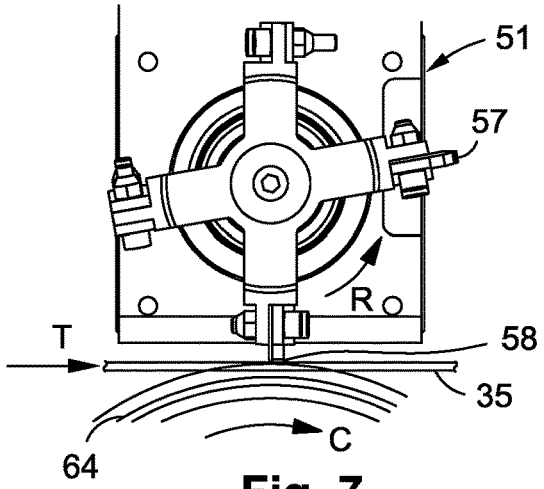
Figure 8:
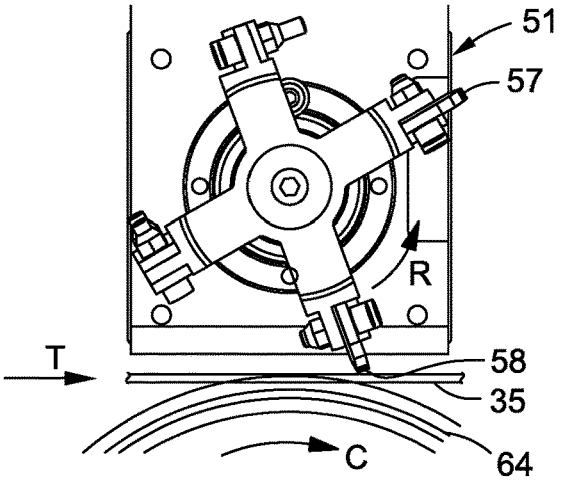
Figure 9:
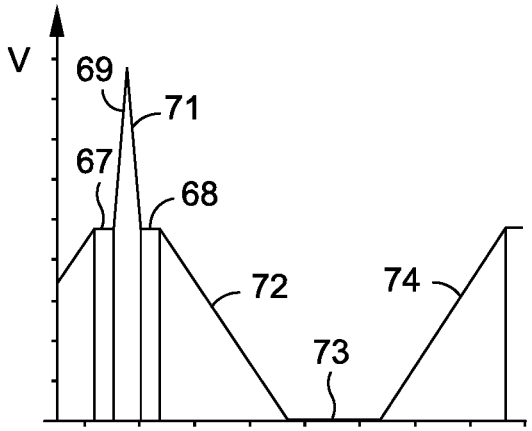
FIGS. 9 to 14 show various graphs of the device speed during the rotation cycle.
Figure 10:
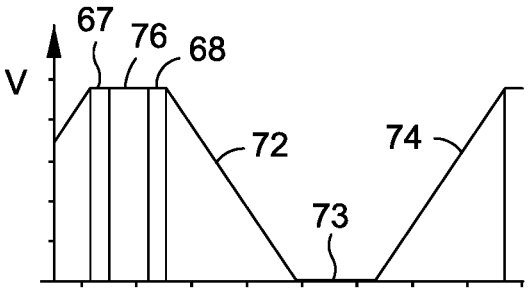
Figure 11:
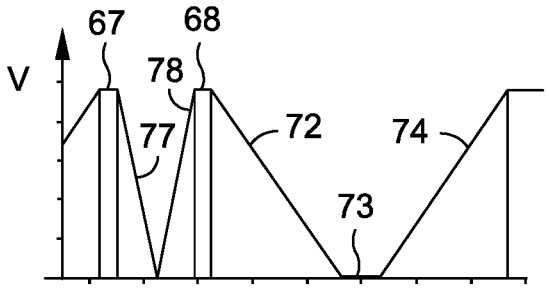
Figure 12:
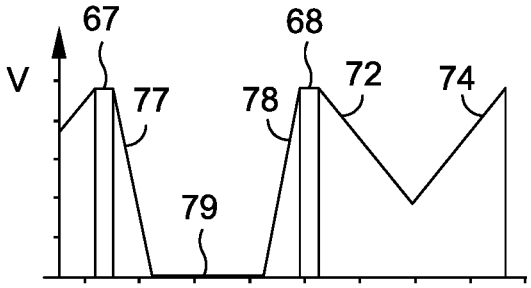
Figure 13:
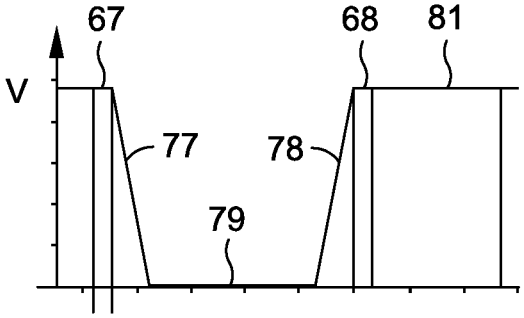
Figure 14:
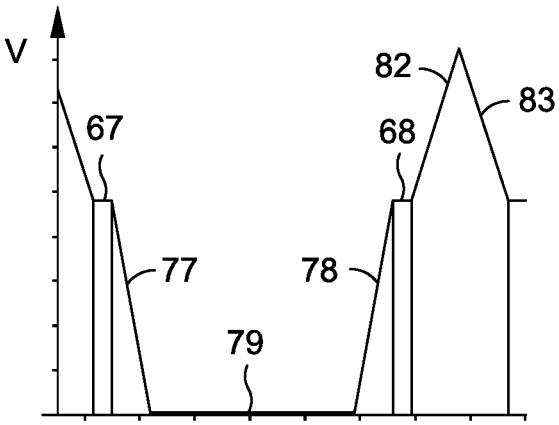

Two arms 54 and 56 are preferably inserted into the hub 52 and extend radially from the hub 52 (see FIG. 3). A first processing tool, which in this case is a first tool comprising a cutting blade 57, is mounted on the free end of the first arm 54. A second processing tool, which in this case is a tool comprising a cutting blade 58, is mounted on the free end of the second arm 56. The two processing tools are thus cantilevered above the sheet 35. This cantilevered arrangement of the hub 52, the two arms 54 and 56 and the two tools 57 and 58 unweights this device 51, thereby making it possible to reduce the inertia of the device 51 and improve its acceleration and deceleration performance.

The cutting edges of the two cutting tools 57 and 58 are preferably slanted in the horizontal plane relative to the axis 53 of the hub 52, so as to produce the two slanted cuts 31 and 32 in the sheet 35. During the two successive cutting operations, the cutting edge of each of the two cutting tools 57 and 58 is located parallel to the plane of the sheet 35.

It is particularly advantageous for the two arms and thus the two tools 57 and 58 to be positioned radially at an angle $\alpha$ relative to each other, said angle $\alpha$ being substantially smaller than 180° and preferably substantially equal to 100°.

Preferably, and in order to balance the rotation of the device 51, the first arm 54 is extended diametrically by a third arm 59, either forming a counterweight itself or being equipped with a counterweight 61 on its free end. The second arm 56 is extended diametrically by a fourth arm 62, either forming a counterweight itself or being equipped with a counterweight 63 on its free end.

The hub 52 with the two arms 54 and 56 and thus the two tools 57 and 58 and the two counterweight arms 59 and 61 are driven in rotation by virtue of driving means in the form of an electrical motor mounted directly on the axis 53.

To ensure the device 51 makes precise cuts in the sheet 35, the processing unit 34 preferably comprises a counter-tool or counterpart 64. Given the proximal position of the flap 27 on the blank 1, and the mounting of the device 51, the counterpart 64 is mounted on the end located on the operator side of the lower shaft of the creasing section 43. The device 51 and the counterpart 64 are located in between the first slotting section 39 and the second slotting section 47.

The counterpart 64 is a cylinder rotating (arrow C in FIGS. 2 to 8) about a substantially horizontal transverse axis that lies substantially parallel to the axis 53 of rotation of the hub 52 of the device 51. Preferably, the speed of rotation C of the counterpart 64 is synchronized and constant and substantially equivalent to the constant operating speed, i.e. the drive speed and running speed T of the sheets 35. The counterpart 64 is driven separately to the hub 52. The sheet 35 runs in a substantially horizontal plane located between the two tools 57 and 58 and the counterpart 64.

The counterpart 64 is coated with a coating 66 made of a material chosen for its softness, such as a layer of polyurethane for example. The two tools 57 and 58 cut the sheet 35 and penetrate one after the other into the coating of the counterpart 64, thereby making it possible to achieve a sharp, burr-free cut in the sheet 35. By virtue of the polyurethane, the blades of the two tools 57 and 58 wear less and are much less likely to break.

As FIGS. 3 to 8 show, the hub 52 of the device 51 rotates so that the sheet 35 is cut, in succession, in a complete rotation cycle, by the first tool 57 and then by the second tool 58.

The first tool 57 makes contact with the sheet 35 (see FIG. 3). The first tool 57 makes the front cut 32 in the exact location of the flap 27 (see FIG. 4). The first tool 57 disengages from the sheet 35 once the front cut 32 has been made (see FIG. 5). The second tool 58 makes contact with the sheet 35 (see FIG. 6). The second tool 58 makes the rear cut 31 in the exact location of the flap 27 (see FIG. 7). The second tool 58 disengages from the sheet 35 once the rear cut 31 has been made (see FIG. 8). Next, the rotation cycle continues with the following sheet 35.

To enable flaps 27 with various lengths to be cut in sheets 35 of various sizes, and according to the invention, the speed V of rotation R of the hub 52, and therefore of the device 51, varies during a rotation cycle. The phases of variation in speed V for various exemplary flaps 27 are shown in FIGS. 9 to 14 as a function of progress through the rotation cycle.

In any case, the cuts 31 and 32 are cut at a constant speed. During the rotation R cycle, the speed V is first of all, in a first phase 67, kept constant at a speed substantially equal to the operating speed. In this first phase, the first tool 57 is located in its cutting position and makes the front cut 32 in the sheet 35. The speed V is then, in a second phase 68, kept constant at a speed substantially equal to the operating speed. In this second phase the second tool 58 is located in the cutting position and makes the rear cut 31 in the sheet 35.

During the same rotation R cycle, the speed V then varies in at least one variable-speed phase. In this or these phases, each of the two tools 57 and 58 is located in an intermediate position between their respective cutting positions. The intermediate position corresponds to the position of the device 51 at the moment when the tool 57 or disengages from the sheet 35. The speed V varies, the motor driving the hub 52 of the device 51 accelerating or decelerating the rotation R in order to ensure that the cuts 31 and 32 are obtained in the desired locations.

Since the hub 52 is driven independently of the counterpart 64, its inertia is greatly reduced and thus large accelerations and decelerations are possible. The entire range of flap 27 lengths between 100 mm and 700 mm can be covered. In addition, the cuts 31 and 32 may be made at high operating speeds.

This or these phases may be inserted between two constant-speed phases consisting of a first phase in which the first tool 57 is located in the processing position, and a second phase in which the second tool 58 is located in the processing position, in a first rotation cycle of the hub 52. This or these phases may be inserted between two constant-speed phases consisting of a second phase in which the second tool 58 is located in the processing position in a first rotation cycle of the hub 52, and a first phase in which the first tool 57 is located in the processing position, in a second rotation cycle of the hub 52, following the first cycle.

For example, to obtain a flap 27 substantially between 100 mm and 125 mm in length, the variation in the speed V of rotation R (see FIG. 9) comprises, in succession, an acceleration phase 69 and a deceleration phase 71 in between the two constant-speed phases 67 and 68. Next, once the rear cut 31 has been made during the second constant-speed phase 68, the variation in the speed V of rotation R comprises, in succession, a deceleration phase 72, a stop phase 73 and then an acceleration phase 74 before the front cut 32 is reproduced in the following sheet during the first constant-speed phase 67 of the following cycle.

For example, to obtain a flap 27 of substantially 125 mm in length, the speed V of rotation R is kept constant (see FIG. 10) in an intermediate constant-speed phase 76 in between the two constant-speed phases 67 and 68. Next, once the rear cut 31 has been made during the second constant-speed phase 68, the variation in the speed V of rotation R comprises, in succession, a deceleration phase 72, a stop phase 73 and then an acceleration phase 74 before the front cut 32 is reproduced in the following sheet during the first constant-speed phase 67 of the following cycle.

For example, to obtain a flap 27 substantially between 125 mm and 210 mm in length, the variation in the speed V of rotation R (see FIG. 11) comprises, in succession, a deceleration phase 77 and then an acceleration phase 78 in between the two constant-speed phases 67 and 68. Next, once the rear cut 31 has been made during the second constant-speed phase 68, the variation in the speed V of rotation R comprises, in succession, a deceleration phase 72, a stop phase 73 and then an acceleration phase 74 before the front cut 32 is reproduced in the following sheet during the first constant-speed phase 67 of the following cycle.

For example, to obtain a flap 27 substantially between 210 mm and 575 mm in length, the variation in the speed V of rotation R (see FIG. 12) comprises, in succession, a deceleration phase 77 and then a stop phase 79, and then an acceleration phase 78 in between the two constant-speed phases 67 and 68. Next, once the rear cut 31 has been made during the second constant-speed phase 68, the variation in the speed V of rotation R comprises, in succession, a deceleration phase 72 and then an acceleration phase 74 before the front cut 32 is reproduced in the following sheet during the first constant-speed phase 67 of the following cycle.

For example, to obtain a flap 27 substantially 575 mm in length, the variation in the speed V of rotation R (see FIG. 13) comprises, in succession, a deceleration phase 77, a stop phase 79, and then an acceleration phase 78, in between the two constant-speed phases 67 and 68. Next, once the rear cut 31 has been made during the second constant-speed phase 68, the speed V of rotation R remains constant in an intermediate constant-speed phase 81 before the front cut is reproduced in the following sheet during the first constant-speed phase 67 of the following cycle.

For example, to obtain a flap 27 substantially between 575 mm and 700 mm in length, the variation in the speed V of rotation R (see FIG. 14) comprises, in succession, a deceleration phase 77, a stop phase 79, and then an acceleration phase 78, in between the two constant-speed phases 67 and 68. Next, once the rear cut 31 has been made during the second constant-speed phase 68, the variation in the speed V of rotation R comprises, in succession, an acceleration phase 82 and then a deceleration phase 83 before the front cut 32 is reproduced in the following sheet during the first constant-speed phase 67 of the following cycle.

The present invention is not limited to the embodiments described and illustrated. A number of modification may be made without however departing from the scope defined by the breadth of the set of claims.

What is claimed is:

1. A method of processing a plate element by a processing device mounted on a lateral side of a packaging production machine, the packaging production machine feeding the plate element in a longitudinal direction at an operating speed, the processing device comprising:

a hub supported and configured to rotate about a substantially horizontal first rotation axis transverse to the longitudinal direction;

two tools mounted on the hub spaced apart around the first rotation axis, a first tool of the two tools configured to process the plate element at a first processing position of the first tool, and a second tool of the two tools being configured to process the plate element at a second processing position of the second tool, the first tool being configured to process the plate element at a front lateral processing position on the plate element, and the second tool being configured to process the plate element at a rear lateral processing position on the plate element, wherein the front lateral processing position and the rear lateral processing position are along a lateral edge of the plate element;

a hub drive configured to drive the hub and the two tools in rotation around the first rotation axis;

a counter-tool supported and configured to rotate about a second rotation axis that is substantially horizontal, transverse to the longitudinal direction, and parallel to the first rotation axis of the hub, the plate element being engaged successively between the first tool and the counter-tool and between the second tool and the counter-tool; and the hub drive being configured and operable to drive the hub at a speed of rotation that varies during a rotation cycle of the hub, wherein the method comprises:

operating the processing device;

controlling the hub drive to implement a first phase and a second phase of the rotation cycle, during an entirety of the first and second phases, the hub being driven at a constant speed substantially equal to the operating speed, such that in the first phase the first tool is in the first processing position for processing the front lateral processing position on the plate element and in the second phase the second tool is in the second processing position for then processing the rear lateral processing position on the plate element; and controlling the hub drive to implement at least one third phase of the rotation cycle, the at least one third phase occurring after the first phase and before the second phase, and during the at least one third phase, driving the hub at a non-zero rotation speed that is different from the constant hub rotation speed and is set according to a distance on the plate element between the front lateral processing position and the rear lateral processing position, wherein during the at least one third phase, each of the two tools is moved through a respective intermediate position, in order to reach the corresponding first processing position and the second processing position for processing the plate element at, respectively, the front lateral processing position and the rear lateral processing position; and operating the counter-tool to have a speed of rotation throughout the at least one third phase that is substantially equal to the operating speed.

2. The method according to claim 1, wherein the at least one third phase includes, in succession, a phase of acceleration and a phase of deceleration.

3. The method according to claim 2, wherein the at least one third phase includes an intermediate phase at the constant speed.

4. The method according to claim 1, wherein the at least one third phase includes, in succession, a deceleration phase and an acceleration phase.

5. The method according to claim 1, wherein the at least one third phase includes, in succession, a deceleration phase, a stop phase and an acceleration phase.

6. The method according to claim 1, wherein during the second phase the second tool is located in the rear lateral processing position in the rotation cycle of the hub, and wherein during the first phase the first tool is located in the front lateral processing position, of a subsequent rotation cycle of the hub following the rotation cycle.

7. The method according to claim 1, wherein the hub is supported in a cantilevered manner.

8. The method according to claim 1, wherein the two tools are positioned radially at an angle relative to each other, the angle being smaller than 180°.

9. The method according to claim 8, wherein the angle is substantially equal to 100°.

10. The method according to claim 1, wherein a respective arm for each tool is securely fastened on the hub and positioned and configured to rotate with the hub; and each tool is mounted on an end of the respective arm.

11. The method according to claim 10, wherein each of the two arms is extended diametrically by an arm forming a counterweight.

12. The method according to claim 1, wherein the counter-tool comprises a cylinder coated with a coating made of a material having a softness such that the two tools penetrate the coating therein.

13. The method according to claim 12, wherein the coating comprises a layer of polyurethane.

14. The method according to claim 1, wherein the processing device is mounted in a creasing section of the packaging production machine.

* * * * *